United States Patent [19]

Boehm et al.

[11] Patent Number: 4,506,131

[45] Date of Patent: Mar. 19, 1985

[54] MULTIPLE ZONE INDUCTION COIL POWER CONTROL APPARATUS AND METHOD

[75] Inventors: Paul C. Boehm, Marlton; John H. Mortimer, Medford; Henry M. Rowan, Rancocas; Robert C. Turner, Beverly, all of N.J.

[73] Assignee: Inductotherm Industries Inc., Rancocas, N.J.

[21] Appl. No.: 527,148

[22] Filed: Aug. 29, 1983

[51] Int. Cl.[3] ..... H05B 6/08

[52] U.S. Cl. ..... 219/10.77; 219/10.41; 219/10.71; 219/503; 323/329

[58] Field of Search ..... 219/10.77, 10.71, 10.75, 219/10.41, 10.43, 485, 490, 497, 503; 323/329, 331

[56] References Cited

U.S. PATENT DOCUMENTS

| | | | |
|---|---|---|---|
| 2,773,161 | 12/1956 | Baker | 219/10.77 |
| 2,813,186 | 11/1957 | Bock | 219/10.77 X |
| 3,291,969 | 12/1966 | Speransky et al. | 219/503 |
| 3,346,712 | 10/1967 | Seyfried | 219/8.5 |
| 3,612,805 | 10/1971 | Kennedy | 219/10.75 |
| 3,743,808 | 7/1973 | Kasper | 219/10.41 |
| 4,307,276 | 12/1981 | Kurata et al. | 219/10.41 |

*Primary Examiner*—Philip H. Leung

*Attorney, Agent, or Firm*—Seidel, Gonda & Goldhammer

[57] ABSTRACT

A plurality of zones of an induction heating coil are individually controlled by varying the current through one or more zones of the coil to obtain a desired temperature profile in a workpiece. The current flow through a zone of the coil is determined by the conduction state of an associated saturable reactor, which is controlled in accordance with a preselected value or a variable value generated, for example, by a computer.

15 Claims, 3 Drawing Figures

MULTIPLE ZONE INDUCTION COIL POWER CONTROL APPARATUS AND METHOD

BACKGROUND OF THE INVENTION

The induction heating of metal products to desired temperatures is well-known and commonly practiced. In conventional induction heating, a metal workpiece is heated by an induction heating coil by placing the coil around the workpiece and passing electric current through the coil. The electric current passing through the coil produces a magnetic field and induces secondary currents in the workpiece. The secondary currents flowing through the workpiece heat it.

It is sometimes desirable to heat different areas or zones of the workpiece so as to obtain a non-uniform temperature profile along the length of the workpiece. By applying different amounts of power to different zones of a workpiece placed within the induction coil, reproducible temperature profiles can be obtained. These reproducible temperature profiles yield desirable effects in the workpiece, especially in metallurgical processes involving crystal growth.

In accordance with the present invention, a desired temperature profile is obtained by shunting various zones of the induction heating coil, corresponding to various zones of a workpiece, with a saturable reactor. For a particular combination of voltage and current through a zone of the heating coil, the saturable reactor may be made to conduct and divert current from the zone of the heating coil. By controlling the amount of current diverted, or shunted, across a zone, the power in that zone, and therefore the temperature of the workpiece in that zone, may be controlled.

It is an object of the present invention to individually control the amount of power to one or more of several zones of an induction heating coil to produce a desired temperature profile in a workpiece.

SUMMARY OF THE INVENTION

The present invention is an apparatus for individually controlling power delivered to each of a plurality of zones of an induction heating coil so as to provide a desired temperature profile in a workpiece heated by the coil. The apparatus comprises a high-frequency induction power supply for delivering power to the coil and means for measuring the power in each zone. The apparatus also comprises means for comparing the power in each zone to a predetermined reference and generating a first control signal based on the comparison and means operatively associated with each zone in response to the first control signal for diverting electric current around that zone to thereby control the power delivered to the zone. The apparatus further comprises means for determining the total power delivered by the power supply, means for adding the power in each zone to determine the total power in all zones, and means for comparing the total power in all zones to the total power delivered by the power supply and generating a second control signal based on the comparison for controlling the total power delivered by the power supply.

The present invention also includes a method for individually controlling the power delivered to each of a plurality of zones of an induction heating coil so as to provide a desired temperature profile in a workpiece heated by the coil. The method comprises the steps of delivering high frequency power to the coil, measuring the power in each zone of the coil, comparing the power in each zone to a predetermined reference and generating a first control signal based on the comparison, diverting electric current around that zone in response to the first control signal to thereby control the power delivered to that zone, determining the total power delivered to the coil, adding the power in each zone to determine the total power in all zones to the total power delivered to the coil and generating a second control signal based on the comparison for controlling the total power delivered to the coil.

For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 2(*b*) is a curve showing the relationship between control current in a saturable reactor and heating coil current controlled by the saturable reactor.

DETAILED DESCRIPTION OF THE INVENTION

Figure 1:
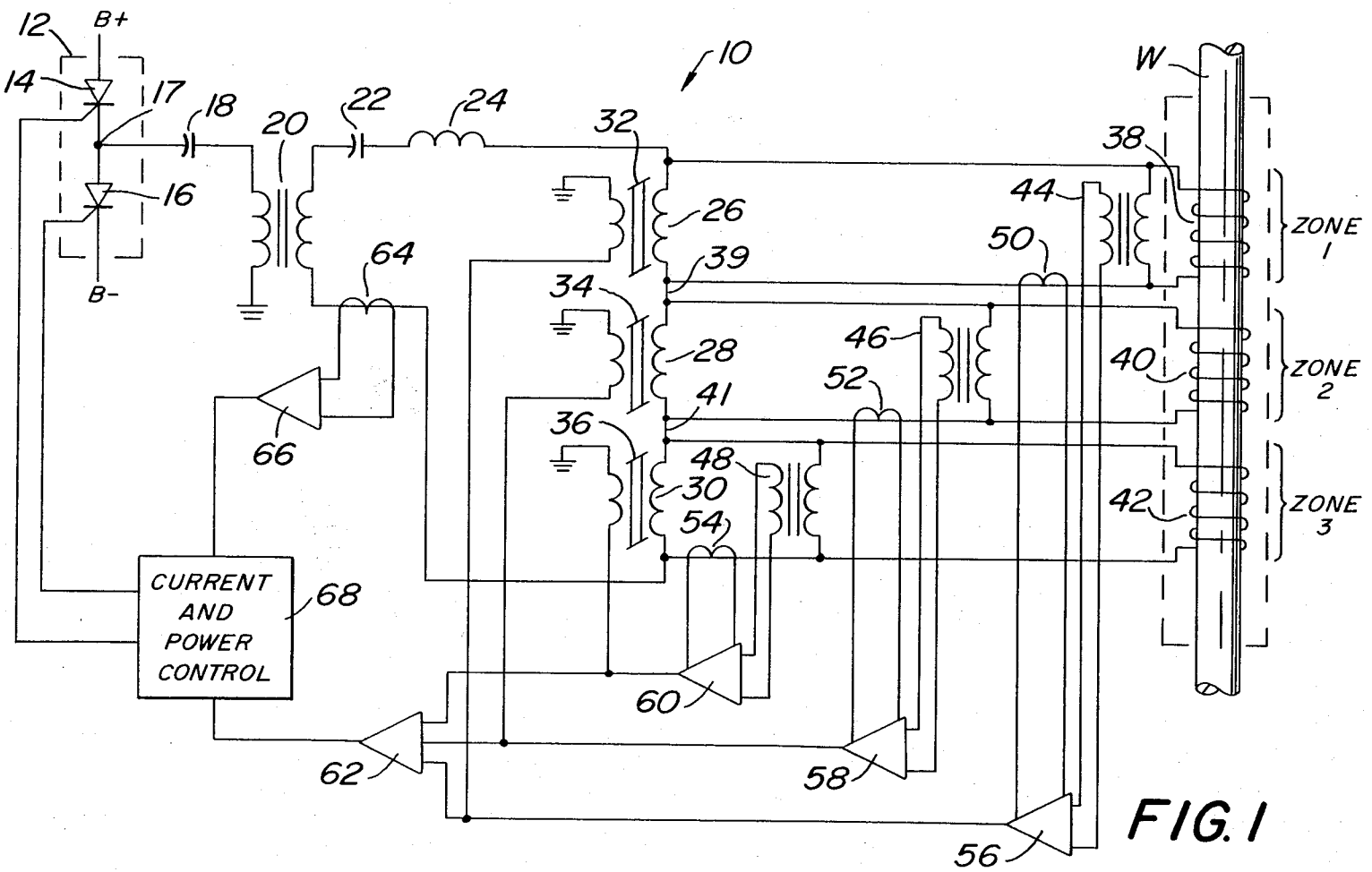
FIG. 1 is a schematic diagram of a control apparatus in accordance with the present invention.

Referring now to FIG. 1, there is shown a schematic diagram of a control circuit in accordance with the present invention, generally designated by the numeral 10.

A high-frequency induction power supply 12 generates a high-frequency ac voltage. Power supply 12 may be manually adjustable to deliver a desired power output, and is preferably a constant current power supply. In the embodiment shown in the drawing, power supply 12 includes an inverter stage having two silicon controlled rectifiers (SCRs) or thyristors 14 and 16 connected in series between a positive voltage source B+ and a negative voltage source B−. The output current of power supply 12 is controlled by SCRs 14 and 16, as will be more fully explained below. The manner in which SCRs 14 and 16 may be switched, or "gated", and their operation in current-limiting power supplies will be well understood by those skilled in the art, and need not be described here in detail.

The cathode of SCR 14 and the anode of SCR 16 are connected together at node 17, which represents the output terminal of power supply 12. Node 17 is connected to one terminal of capacitor 18. The opposite terminal of capacitor 18 is connected to one terminal, or leg, of the primary winding of load matching transformer 20. The other leg of the primary of transformer 20 is connected to a neutral potential. The secondary winding of transformer 20 is connected essentially in series with the induction heating coil which is composed of coil sections 38, 40 and 42, which are connected in series at nodes 39 and 41. Capacitor 22 and reactor 24 are inserted in series with one leg of the secondary of transformer 20 between the transformer and the heating coil. Capacitors 18 and 22 provide power factor correction to maximize power transfer from the power supply 12 to the induction heating coil sections 38, 40 and 42, and also serve to determine the resonant frequency of the load circuit. Reactor 24 is a stabilizing reactor which eliminates double frequency harmonics introduced when the saturable reactors are conducting. Reactor 24 preferably has about three times the inductance of the heating coil sections 38, 40 and 42, so that any variation in heating coil impedance during operation will have only a small effect on the impedance of the load circuit. The operation of the saturable reactors and their effect will be explained more fully below.

As noted above, the induction heating coil is composed of three coil sections 38, 40 and 42, although any number of coil sections may be used without departing from the scope of the present invention. However, three coil sections suffice to explain the invention. Each coil section 38, 40 and 42 defines a zone, in this case zone 1, zone 2 and zone 3, respectively, of the workpiece W.

A saturable reactor 26, 28 and 30 is placed across (i.e., in parallel with) each of the coil sections 38, 40 and 42, respectively. Each saturable reactor is connected with its secondary winding in parallel with its associated coil section so as to divert, or shunt, current around the associated coil section. Each saturable reactor 26, 28 and 30 contains a saturable element or core 32, 34 and 36, respectively, of high magnetic permeability.

Figure 2A:
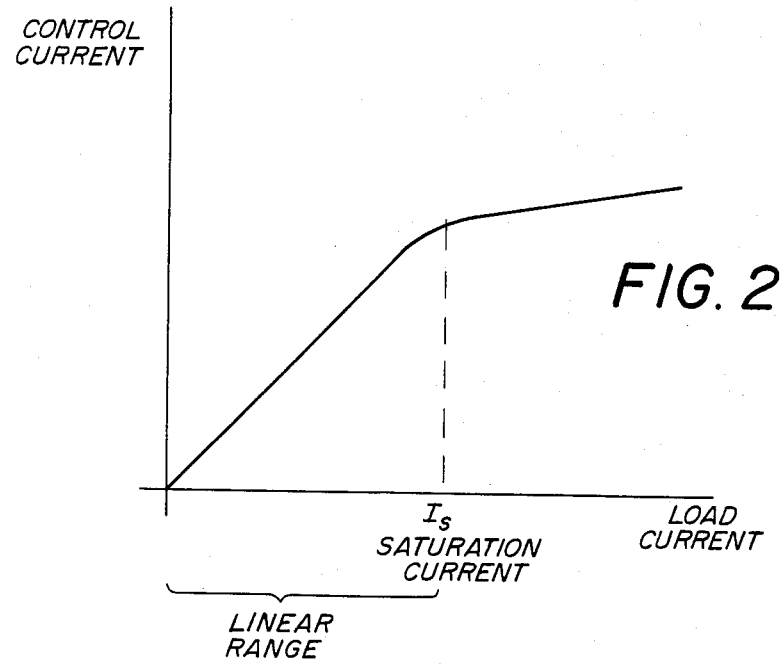
FIG. 2(*a*) is a curve showing the relationship between control current and load current in a saturable reactor.
Figure 2B:
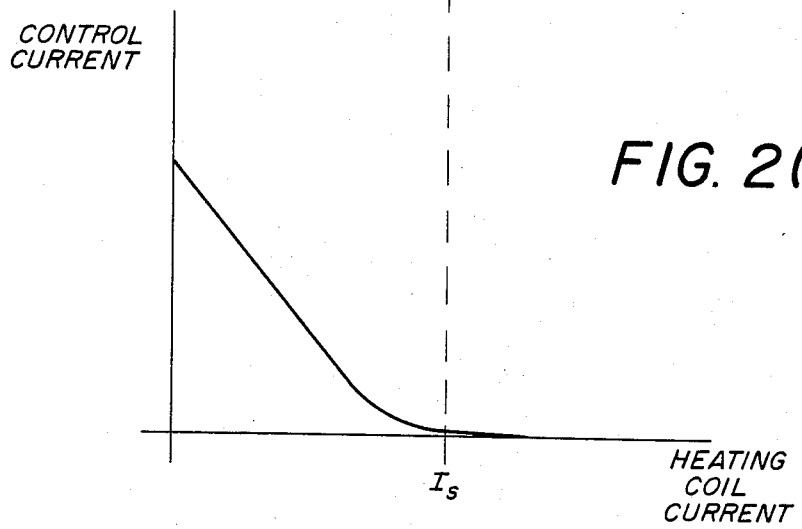

The saturable reactors control the amount of current through the associated section of the heating coil. The primary, or control, winding of each reactor carries a direct current, called the control current, of adjustable magnitude, which can saturate the core. The dc current is provided by power transducers and comparators 56, 58 and 60, as will be explained more fully below. The magnitude of the control current determines the extent to which the core is saturated. The intensity of saturation of the core in turn controls the effective inductance of the secondary, or load, winding of the reactor. As will be understood by those skilled in the art, the relationship between control current and the inductance of the load winding has a linear range between the points where the core is fully saturated. See FIG. 2(*a*). Since the impedance of the load winding at a given frequency is proportional to the inductance, the relationship between the load winding impedance and the control current is also linear in the range between the extremes of saturation. Naturally, since load current is proportional to the impedance of the load winding, the relationship between the control current and the load current also has a linear range.

When the core is fully saturated by the control current, the effective inductance (and therefore the impedance) of the load winding is small. Reducing the magnitude of the control current reduces the intensity of saturation of the core. This increases the impedance of the load winding and brings the reactor into the linear range of operation. Thus, by controlling the dc voltage applied across the control winding of the reactor, the impedance of the load winding of the reactor may be controlled. When the voltage across the control winding is such that the load winding has a very high impedance, virtually no current will flow through the load winding. In this case, all current will flow through the associated coil section. Conversely, when the voltage across the control winding is such that the impedance of the load winding is low, current will flow through the load winding instead of the associated coil section, thus shunting current around the associated coil section. In between these extremes, in the linear range, the current through the load winding is proportional to the control current.

As will be appreciated, when the impedance of the load winding is low, no in phase current flows through the associated coil section, and therefore the power delivered by that coil section to the workpiece is zero. Conversely, when the impedance of the load winding is high, all of the current flows through the associated coil section, and thus the power delivered by the coil section is at its maximum. For points between these extremes, current in the coil section is inversely proportional to the control current and varies linearly. See FIG. 2(*b*). It can thus be seen that varying the impedance of the load winding of one of saturable reactors 26, 28 or 30 varies the power delivered by the associated coil section 38, 40 or 42 to the workpiece.

A side effect of the operation of the saturable reactors 26, 28 and 30 is the introduction of double frequency harmonics. When one of the saturable reactors is conducting, it will conduct current during a portion of both the positive and negative swings of the current in the secondary of load matching transformer 20, thereby introducing the double harmonic frequency component. Stabilizing reactor 24 is placed in series with the secondary of transformer 20 to eliminate the double frequency harmonic component.

Power in each coil section 38, 40 and 42 is sensed by potential transformers 44, 46 and 48 and current transformers 50, 52 and 54 respectively. Potential transformer 44 and current transformer 50 provide the inputs to power transducer and comparator 56, potential transformer 46 and current transformer 52 provide the inputs to power transducer and comparator 58, and potential transformer 48 and current transformer 54 provide the inputs to power transducer and comparator 60. Power transducers and comparators 56, 58 and 60 compute the power in coil sections 38, 40 and 42, respectively, based on the voltage at the secondary of the potential transformer 44, 46 and 48, respectively, and the current sensed by the current transformer 50, 52 and 54, respectively. The product of the sensed voltage and sensed current yields the sensed power in the associated coil section.

The sensed power is compared within power transducers and comparators 56, 58 and 60 to a predetermined set point, or reference, power. The outputs of power transducers and comparators 56, 58 and 60 will be a dc voltage proportional to the difference between the sensed and reference powers. The outputs of power transducers annd comparators 56, 58 and 60 provide the control currents to the control windings of saturable reactors 26, 28 and 30, respectively. Accordingly, the intensity of saturation of the core of the associated saturable reactor 26, 28 and 30 is varied in response to the dc output of comparators 56, 58 and 60, respectively, so as to increase or decrease the load impedance of the reactor, and thus the current shunted around the associated coil section.

The outputs of power transducers and comparators 56, 58 and 60 are also summed in power adder 62. The output of power adder 62 thus represents the total power being dissipated in coil sections 38, 40 and 42. The output of power adder 62 provides one input to the current and power control circuit 68. The second input to current and power control circuit 68 is the output of current transducer 66. The input of current transducer 66 is derived from current transformer 64, which is located in the return leg of the secondary of load matching transformer 20. Since current transformer 64 is located in series with the secondary of load matching transformer 20, current transformer 64 senses the total current in the secondary of load matching transformer 20. That is, current transformer 64 senses not only current flowing through coil sections 38, 40 and 42, but current shunted by saturable reactors 26, 28 and 30 as well. The current sensed by current transformer 64 is proportional to, and thus a measure of, the total power supplied to the load circuit by the secondary of load matching transformer 20.

Current and power control circuit 68 may be any conventional analog comparison circuit and compares the total power being supplied by the secondary of load matching transformer 20 to the desired output. Based on this comparison, current and power control circuit 68 generates gating pulses which control the gating of SCRs 14 and 16. The frequency of the gating pulses is increased or decreased depending upon whether more of less current is required from power supply 12. Changing the frequency of the gating pulses changes the frequency of the power supply output. It is known that for a given set of conditions, the load circuit of transformer 20 will have a resonant frequency. Current, and hence power, to the load circuit will be at a maximum when the frequency of power supply 12 is at that resonant frequency. Current, annd hence power, to the load circuit will decrease as the frequency of power supply 12 decreases from resonance. Thus, by controlling the firing rate of SCRs 14 and 16, the total current delivered by the secondary of load matching transformer 20, and hence the total power, can be controlled.

The output of power adder 62 is compared in current and power control circuit 68 to a maximum power reference which represents the maximum power which can safely be drawn from power supply 12. Any conventional comparison circuitry may be used. Current and power control circuit 68 limits in known manner the output current of power supply 12 based on the comparison so that the power output of power supply 12 will not exceed a safe maximum.

The power delivered to coil sections 38, 40 and 42 may thus be varied according to any desired temperature profile to achieve the desired results in workpiece W. The precise details of current and power control circuit 68 and comparators 56, 58 and 60 are not crucial to the present invention. Any convenient and conventional control and comparator circuitry may be employed without departing from the scope of the present invention.

The desired temperature profile likewise may be generated in any convenient and conventional manner, and may be a predetermined profile or a variable profile generated, for example, by a computer.

The present invention may be embodied in other specific forms without departing from the spirit or essential attributes thereof and, accordingly, reference should be made to the appended claims, rather than to the foregoing specification, as indicating the scope of the invention.

We claim:

1. Induction heating apparatus for providing a desired temperature profile in a workpiece to be heated, comprising:

(a) an induction heating coil having a plurality of zones, (b) a high-frequency induction power supply for delivering power to the coil, (c) control means for individually controlling the power delivered to each zone of the coil, the control means comprising:

(i) means for measuring the power in each zone, (ii) means for comparing the power in each zone to a predetermined reference and generating a first control signal based on the comparison for each respective zone, (iii) means operatively associated with each zone and responsive to the first control signal associated with the respective zone for diverting electric current around the respective zone to thereby control the power delivered to the respective zone, (iv) means for determining total power delivered by the power supply, (v) means for adding the power in each zone to determine a total power in all zones, and (vi) means for comparing the total power in all zones to the total power delivered by the power supply and generating a second control signal based on the comparison for controlling the total power delivered by the power supply.

2. Apparatus according to claim 1, wherein the high-frequency induction power supply is directly responsive to the second control signal.

3. Apparatus as in claim 2, wherein the power supply includes at least two switch means connected in series between a positive voltage source and a negative voltage source, each switch means being controlled by the second control signal.

4. Apparatus as in claim 3, wherein the switch means are silicon controlled rectifiers.

5. Apparatus according to claim 1, wherein the means for measuring the power in each zone includes means for sensing the potential across the portion of the coil in the respective zone and means for sensing the current through the portion of the coil in the respective zone.

6. Apparatus according to claim 5, wherein the means for sensing the potential is a potential transformer.

7. Apparatus according to claim 5, wherein the means for sensing the current is a current transformer.

8. Apparatus as in claim 1, wherein the means operatively associated with each zone and responsive to the first control signal associated with the respective zone for diverting electric current around the respective zone is a saturable reactor connected in parallel with the portion of the coil in the respective zone.

9. Apparatus as in claim 1, wherein the means for determining total power delivered by the power supply includes means for sensing total current delivered by the power supply.

10. Apparatus as in claim 9, wherein the means for sensing total current is a current transformer.

11. Induction heating apparatus for providing a desired temperature profile in a workpiece to be heated, comprising:

(a) an induction heating coil having a plurality of zones, (b) a high frequency induction power supply for delivering power to the coil, (c) control means for individually controlling the power delivered to each zone of the coil, the control means comprising:

(i) means for sensing the voltage and current in each zone, (ii) means for computing the power in each zone from the sensed voltage and sensed current in the respective zone, (iii) means for comparing the power in each zone to a predetermined reference and generating a first control signal based on the comparison for each respective zone, (iv) shunt means connected in parallel with the coil section in each zone and responsive to the first control signal associated with the respective zone for shunting electric current around the respective zone to thereby control the power delivered to the respective zone, (v) means for sensing total current delivered by the power supply, (vi) means for calculating from the sensed total current the total power delivered by the power supply, (vii) means for adding the power in each zone to determine a total power in all zones, and (viii) means for comparing the total power in all zones to the total power delivered by the power supply and generating a second control signal based on the comparison to limit the output of the power supply to a predetermined maximum.

12. Apparatus as in claim 11, wherein the shunt means is a saturable reactor, the control winding of which is controlled by the first control signal associated with the respective zone and the load winding of which is connected in parallel with the coil section in the respective zone.

13. Induction heating apparatus for providing a desired temperature profile in a workpiece to be heated, comprising:

(a) an induction heating coil having a plurality of zones, (b) a high-frequency induction power supply for delivering power to the coil, the power supply having at least two switch means connected in series between a positive voltage source and a negative voltage source, the output of the power supply being controllable in response to the conduction state of the switch means, (c) control means for individually controlling the power delivered to each zone of the coil, the control means comprising:

(i) means for sensing the voltage and current in each zone, (ii) means for computing the power in each zone from the sensed voltage and sensed current in the respective zone, (iii) means for comparing the power in each zone to a predetermined reference and generating a first control signal based on the comparison for each respective zone, (iv) a saturable reactor operatively associated with each zone and having its load winding connected in parallel with the coil section in the respective zone for shunting electric current around the respective zone to thereby control the power delivered to the respective zone, the control winding of the saturable reactor being controlled by the first control signal associated with the respective zone, (v) means for sensing total current delivered by the power supply, (vi) means for calculating from the sensed total current the total power delivered by the power supply, (vii) means for adding the power in each zone to determine a total power in all zones, and (viii) means for comparing the total power in all zones to the total power delivered by the power supply and generating a second control signal based on the comparison to control the conduction state of the switch means in the power supply.

14. Method for individually controlling the power delivered to each of a plurality of zones of an induction heating coil so as to provide a desired temperature profile in a workpiece heated by the coil, comprising the steps of:

(a) delivering high frequency power to the coil, (b) measuring the power in each zone of the coil, (c) comparing the power in each zone to a predetermined reference and generating a first control signal based on the comparison for each respective zone, (d) diverting electric current around each zone in response to the first control signal associated with the respective zone to thereby control the power delivered to the respective zone, (e) determining the total power delivered to the coil, (f) adding the power in each zone to determine the total power in all zones, and (g) comparing the total power in all zones to the total power delivered to the coil and generating a second control signal based on the comparison for controlling the total power delivered to the coil.

15. Method for individually controlling the power delivered to each of a plurality of zones of an induction heating coil so as to provide a desired temperature profile in a workpiece heated by the coil, comprising the steps of:

(a) delivering variable magnitude high frequency power to the coil, (b) sensing the voltage and current in each zone of the coil, (c) computing the power in each zone from the sensed voltage and sensed current in the respective zone, (d) comparing the power in each zone to a predetermined reference and generating a first control signal based on the comparison for each respective zone, (e) shunting current around each zone in a path connected electrically in parallel with the coil section in the respective zone in response to the first control signal associated with the respective zone to thereby control the power delivered to the respective zone, (f) sensing total current delivered by the power supply, (g) calculating from the sensed total current to the total power delivered by the power supply, (h) adding the power in each zone to determine a total power in all zones, and (i) comparing the total power in all zones to the total power delivered by the power supply and generating a second control signal based on the comparison to limit the high frequency power delivered to the coil to a predetermined maximum.

* * * * *